United States Patent [19]

Sparks et al.

[11] 3,988,833

[45] Nov. 2, 1976

[54] TRACING SCOPE

[76] Inventors: Robert Sparks; George Spector, both of 3615 Woolworth Bldg., 233 Broadway, New York, N.Y. 10007

[22] Filed: Nov. 19, 1974

[21] Appl. No.: 525,057

[52] U.S. Cl. ..... 33/20 C

[51] Int. Cl.[2] ..... B43L 13/16

[58] Field of Search ..... 33/20 R, 20 B, 20 C, 33/76 R

[56] References Cited

UNITED STATES PATENTS

| | | | |
|---|---|---|---|
| 216,460 | 6/1879 | Rosquist | 33/20 C |
| 529,917 | 11/1894 | Joseph | 33/20 C |
| 668,957 | 2/1901 | Fletcher | 33/76 R |
| 811,065 | 1/1906 | Jaeger | 33/20 C |
| 1,605,979 | 11/1926 | Pacioni | 33/20 C X |
| 2,410,447 | 11/1946 | Juran | 33/20 C |

*Primary Examiner*—Richard E. Aegerter
*Assistant Examiner*—Charles E. Phillips

[57] ABSTRACT

A device for use by an artist in order to trace an actual scene or three dimensional object upon a transparent film or sheet; the device consisting of a frame having a pivotable easel leg so that the frame may stand upright, a transparent stiff plastic back sheet forming a window in the frame, a transparent thin plastic sheet or film unwound from a roll supported at one end of the frame so to be pulled across the window and retained in position between the back sheet and frame, an eye opening on the easel leg for observing the painting object from a constant point, and adjustable rulers attached to the frame for guiding the drawing of straight lines upon the film or sheet extending across the window.

1 Claim, 6 Drawing Figures

10
11
12
13
14
15
16
17
18
20
21
22
23
24
25
26
27
28
29
31
32
33
34
35
36
37
38
39
2

12
19
20
21
33

22
34
35

30
31

23
25
27
28
40
41
42

27
28
41
42

TRACING SCOPE

This invention relates generally to tracing devices.

A principle object of the present invention is to provide a tracing scope for being able to trace three dimensional objects or scenes.

Another object is to provide a tracing scope that can be readily collapsed so that it can be conveniently carried by an artist when traveling out-of-doors in search for an ideal scene to be painted.

Still another object is to provide a tracing scope that carried its own supply of sheeting upon which a large number of scenes and objects can be drawn, so that the artist does not need to carry these extra.

Still a farther object is to provide a tracing scope that includes an easel leg so that it is self supporting in standing upright, and wherein the easel leg has an eye observation opening so that a painting object is viewed from a constantly same position.

Other objects are to provide a tracing scope which is simple in design, inexpensive to manufacture, rugged in construction, easy to use and efficient in operation.

These and other objects will be readily evident upon a further study of the following specification, and the accompanying drawing wherein.

Figure 1:
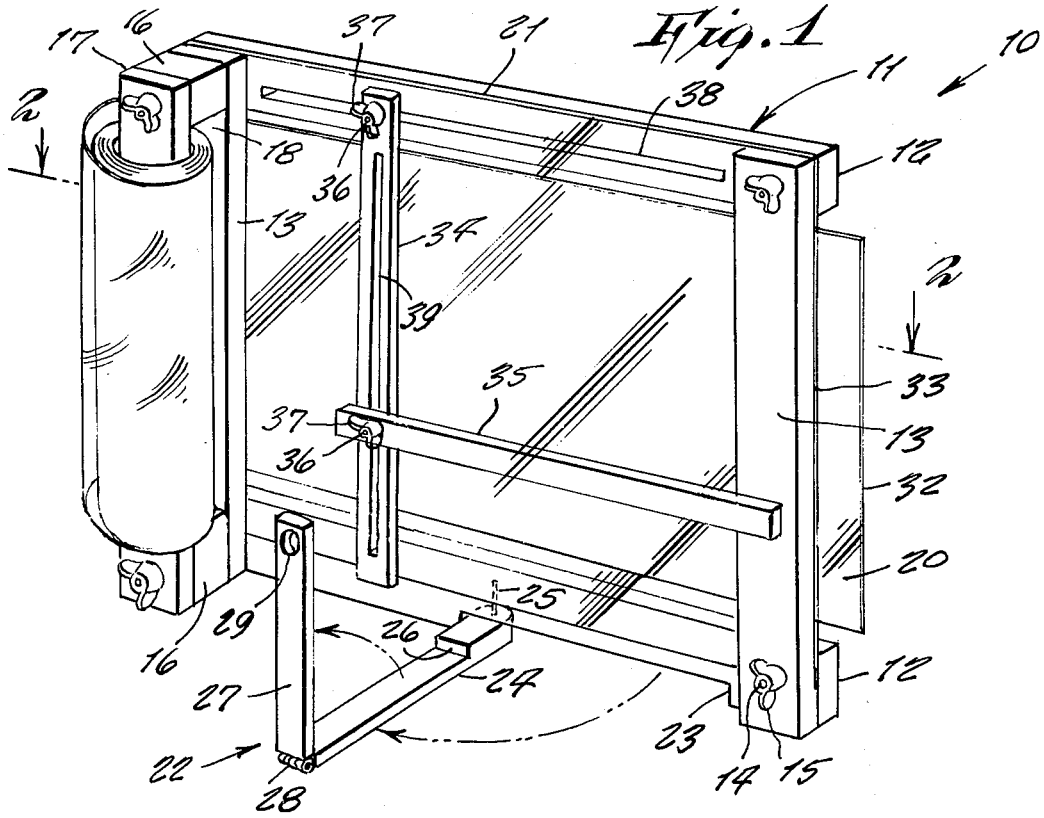
FIG. 1 is a perspective view of the invention.
Figure 2:
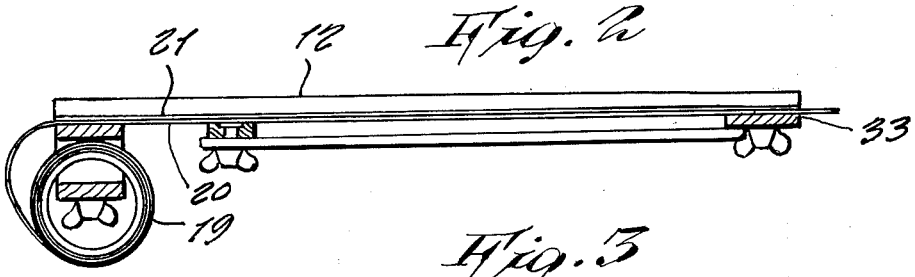
FIG. 2 is a cross section on line 2—2 of FIG. 1.
Figure 3:
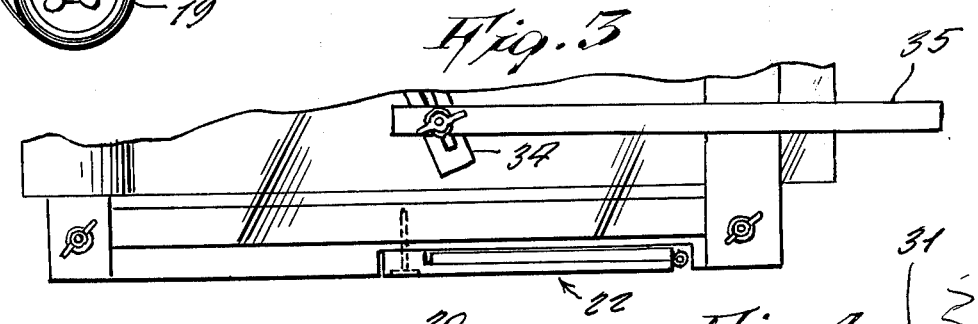
FIG. 3 is a front view of a lower portion of the device showing the leg and viewer in stored away position.

Referring now to the drawings in detail, and more particularly to FIGS. 1 to 4 thereof at this time, the reference numeral 10 represents a tracing scope according to the present invention wherein there is a collapsible wooden frame 11 comprised of horizontal pieces 12 and vertical pieces 13 held together at their corners by removable bolts 14 retained by wing nuts 15. At one side end of the frame, the bolts are longer and additionally are passed through spacer wood blocks 16 and an interconnecting wood bar 17 so to form a space 18 between the bar 17 and frame 11 in order that a roll 19 of relatively thin transparent plastic sheet 20 can be supported on the bar extending therethrough.

A relatively stiffer, transparent plastic sheet 21 is of approximately the same length and width as the frame so that it is clamped between the horizontal and vertical frame piece so to form a clear window of the frame. Openings at the four corners of the sheet 21 are provided so that the bolts 14 can pass therethrough.

The sheet 21 serves as a stiff backing for the sheet 20 that is unwound from the roll 19 and which is pulled between the vertical pieces 13 and the front side of the backing sheet 21 so that it extends horizontally across the frame window so that an artist can then draw upon it. It is to be noted that the sheet 20 is narrower in width than the backing sheet so to not interfere with the bolts 14 as it is pulled from the roll and across the window.

Figure 4:
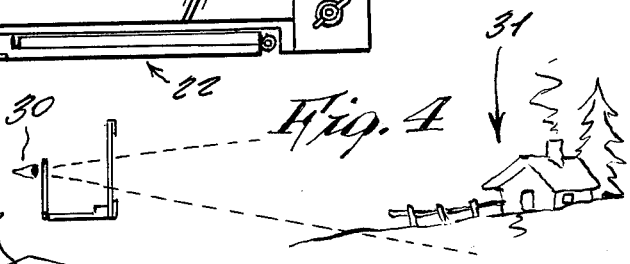
FIG. 4 is a side view of the device is use sketching a house.

An easel 22, normally foldable away within a notch 23 on a lower edge of the bottom horizontal piece 12 consists of a leg 24 pivotable about a nail or screw 25 so it can be pivoted out sideways in order to support the frame upright. A notch 26 in the leg 24 serves to store away an upwardly pivotable leg 27 secured thereto by a hinge 28; the upper end of leg 27 having an opening 29 so a person's eye 30 can be positioned against it in order to observe a scene 31 or object from a constantly same position, when looking through the frame window, as shown in FIG. 4.

In operation it is now evident that an artist can quickly set up the tracing scope for painting upon the sheet 20 that extends across the window. The artist can draw with any paints that will adhere to the plastic surface, and many of which are now available in art supply stores. After finishing a picture, he simply pulls on the end 32 of the sheet 20 so that the finished picture is pulled out of the frame window and which then can be torn off. A serrated metal edge may be included along edge 33 of the piece 12 for this purpose. After thus tearing off the picture, a fresh portion of sheet 20 is now across the window for painting a next picture.

The frame 11 also can incorporate a ruling unit so to guide an artist in drawing straight lines, and which consists of straight rulers 34 and 35 pivotally attached together and to the frame by bolts 36 and wing nuts 37 so that they can be inclined at any desired angle. A slot 38 in the frame upper horizontal piece 12 and a slot 39 along the ruler 33 allows the rulers to be slided horizontally and also vertically for a comple adjustment.

Figure 5:
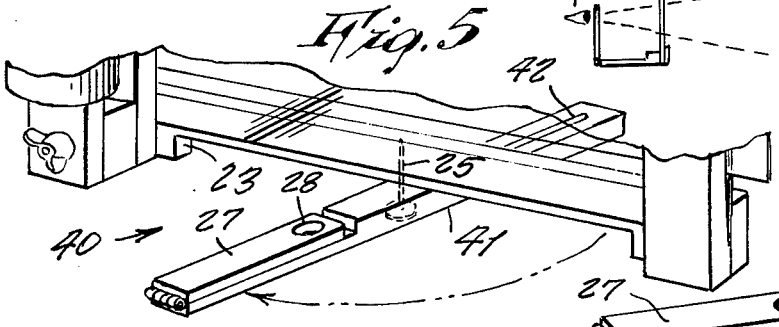
FIG. 5 is a modified design of the invention in which the supporting leg is adjustable so the viewer is closer or farther from the sketching surface so that the drawing layout can be smaller or larger.
Figure 6:
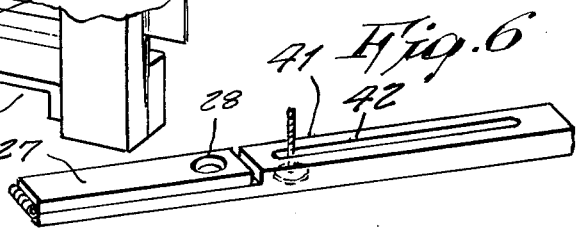
FIG. 6 is a detail of the leg shown in FIG. 5.

In FIGS. 5 and 6, a modified design of tracing scope 40 is the same as above described except that instead of easel leg 24 being pivotable about its one end, it comprises a leg 41 pivotable about its center so that when pivoted at right angle as shown in FIG. 5, both ends thereof extends outward so to prevent the frame to tip either fowardly or rearwardly, for an improved support.

The slot 42 in leg 41 allows the eye observation opening 29 to be brought closer or farther from the sheet 20 so that a composition can be drawn on a larger or smaller scale respectively.

Thus a useful tracing scope is provided.

While various changes may be made in the detail construction, it is understood that such changes will be within the spirit and scope of the present invention, as is defined by the appended claims.

What is claimed is:

1. In a tracing scope, the combination of a wooden frame consisting of parallel lower and upper horizontal pieces and parallel vertical pieces, with the ends of said vertical pieces overlapping ends of said horizontal pieces, said vertical and horizontal pieces being detachably connected by bolts and wing nuts at said overlap, thus forming a rectangular window closed by a stiff transparent plastic backing sheet retained between said horizontal and vertical piece overlap, a pair of spacers mounted on one of said vertical pieces at one end of said frame, said spacers supporting a vertical bar spaced from said frame, said bar supporting a roll of flexible transparent tracing material relatively thin compared to said backing sheet and extendable adjacent a front side of said stiff plastic sheet, so an artist may draw thereupon, a notch along a lower edge of the lower of said horizontal pieces normally storing an easel, said easel comprised of a first leg pivotable for movement in a horizontal plane about a vertical nail supported in said lower horizontal piece at its center, one end of said first leg pivotally supporting a second leg by means of a hinge, said second leg being upwardly pivotable into a vertical plane relative to said first leg and having an eye observation opening therethrough, at its upper end, said easel first leg includes a longitudinal slot receiving said supporting nail for longitudinal sliding displacement of said first leg on said nail relative to said frame such that said opening may be moved with respect to said sheet while said second leg is in its vertical position, said frame also supporting an adjustable ruler unit comprised of a first ruler pivotally and slidably supported along a horizontal slot of one of said horizontal pieces, said first ruler having a longitudinal slot pivotally and slidably supporting a second ruler.

* * * * *